US007321211B2

(12) United States Patent
Peterson

(10) Patent No.: US 7,321,211 B2
(45) Date of Patent: Jan. 22, 2008

(54) POWER VARIATION CONTROL SYSTEM FOR CYCLIC LOADS

(75) Inventor: Ronald G. Peterson, Racine, WI (US)

(73) Assignee: Unico, Inc., Franksville, WI (US)

( * ) Notice: Subject to any disclaimer, the term of this patent is extended or adjusted under 35 U.S.C. 154(b) by 0 days.

(21) Appl. No.: 11/380,861

(22) Filed: Apr. 28, 2006

(65) Prior Publication Data

US 2007/0252546 A1 Nov. 1, 2007

(51) Int. Cl.
*H02P 23/04* (2006.01)

(52) U.S. Cl. ..... 318/432; 318/268; 318/448; 166/104; 417/45

(58) Field of Classification Search ..... 318/432–434, 318/268, 448, 461, 727, 798–801; 166/65.1, 166/66.4, 104; 417/45, 44.11, 321
See application file for complete search history.

(56) References Cited

U.S. PATENT DOCUMENTS 5,204,595 A * 4/1993 Opal et al. ..... 318/430
5,349,278 A * 9/1994 Wedeen ..... 318/632
5,372,482 A * 12/1994 London et al. ..... 417/12
5,425,623 A * 6/1995 London et al. ..... 417/18
6,325,142 B1 12/2001 Bosley et al.
6,414,455 B1 7/2002 Watson
6,470,225 B1 * 10/2002 Yutkowitz ..... 700/44
6,498,449 B1 * 12/2002 Chen et al. ..... 318/434
7,164,250 B2 * 1/2007 Boscolo et al. ..... 318/560
2004/0062657 A1 4/2004 Beck et al.

* cited by examiner

*Primary Examiner*—Bentsu Ro
(74) *Attorney, Agent, or Firm*—Reinhart Boerner Van Deuren P.C.

(57) ABSTRACT

A method and apparatus for managing power demand of a motor in a cyclic load system having a rotational mass is provided. Flat power draw is achieved through continuous manipulation of the motor torque as a function of feedback velocity while using the rotational mass of the cyclic load as a means to store/retrieve energy. Alternatively, reduced variation of power draw is accomplished through continuous manipulation of motor velocity as a function of feedback torque. The methods and apparatus are used in systems where zero or reduced power demand variation is either required or desired, such as in generator powered applications.

34 Claims, 9 Drawing Sheets

POWER VARIATION CONTROL SYSTEM FOR CYCLIC LOADS

FIELD OF THE INVENTION

The present invention relates generally to machine controls and more particularly relates to machine controls in systems having cyclic loads.

BACKGROUND OF THE INVENTION

There are a wide variety of different types of electric motor applications where the load is cyclic in nature. Examples of cyclic load applications include cams, cranks, pumps, sinusoidal loads, regenerative loads, and the like. While the cyclic loading in such applications also requires larger motors and power transmission elements, it can be particularly demanding on the power source for the motor. When the power source is a generator, the cyclic loading typically causes generator over-speeding and/or stalling as the load changes, tending to reduce the operational life of the generators. When the power source is the electric grid provided by a utility company, the cyclic loading increases the peak demand on the grid.

One of the ways industry compensated for cyclic loading was to use larger power sources in the cyclic load applications. When the power source was a generator, a larger and more expensive generator was used resulting in the need for a larger and more expensive engine. Also, using larger generators and engines is generally not as efficient as using optimally sized generators and engines. As a result, the use of fuel to power the engine increased. When the utility supplied electric grid was used as the power source, the rating of the power lines and transformers was increased with a corresponding increase to the cost of these components. In addition to the increased cost and size of the larger components, many electric power providers are now charging higher rates to customers who have higher peak loads.

Another method to attempt to manage the cyclic variation in load has been to vary the frequency of the alternating current power provided to an induction motor, and thereby control its speed, based on historical data, as the power demands of the cyclic load change throughout its cycle. A significant drawback of this approach is the reliance on historical data about the cyclic load. Such an approach does not react quickly to changing conditions affecting the cyclic load. Further, if the cyclic variation in load is such that the generator or other power source is insufficient to operate the machine through a complete cycle, it is impossible to collect the historical data necessary to calculate the frequency commands required to reduce the variation of the load.

BRIEF SUMMARY OF THE INVENTION

Real-time control of the variations in power demand of a motor in a cyclic load system having a rotational mass is provided. Elimination of power variations (i.e., flat power control) is achieved through continuous manipulation of the motor torque as a function of feedback velocity or reduction of power variations (e.g., peak reduction power control) is achieved through manipulation of motor velocity as a function of feedback torque. In both cases, the rotational inertia of the cyclic load is used to store/retrieve energy. The power control is seamlessly integrated with normal operation of the system. The method and apparatus are used in systems where zero or reduced power demand variation is either required or desired, such as in generator powered applications.

In one embodiment, power is regulated by multiplying the average speed request by a scaling factor to generate a power request. The power request is scaled to a percentage of the motor drive rating and is divided by the instantaneous motor feedback speed. The resulting signal is the instantaneous motor torque command corresponding to the power request, which becomes the torque limit.

The power request is adjusted in response to the average cycle speed error, which results in the cyclic load system running at the requested cycle speed. This is accomplished by subtracting the average feedback cycle speed from the requested cycle speed to produce the average cycle speed error. The average cycle speed error is input to a proportional-integral controller and the proportional-integral controller output signal becomes an offset to the scaling factor used to convert the requested cycle speed to a power request. The power request is limited in magnitude and rate of change to protect the power source from peak power levels and sudden changes in power, respectively. This results in the cyclic load system running at the requested cycle speed and at a constant power when in steady state operation.

In another embodiment, power is regulated by determining the torque provided to the motor and multiplying the torque by a gain. If the torque is positive, the result is used as an offset to reduce the instantaneous velocity commanded to the motor. If the torque is negative, the result is used to increase the instantaneous velocity commanded to the motor. The error between the desired speed and the average feedback velocity is integrated and scaled to force the average steady state velocity error to zero.

Other aspects and advantages will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The invention provides a control method and system to attenuate or eliminate power demand variation using instantaneous data. The power control does not require any prior knowledge (i.e., historical data) of the power control system. This eliminates the need to complete one or more cycles of the machine being controlled to collect data for use in the control.

Figure 1:
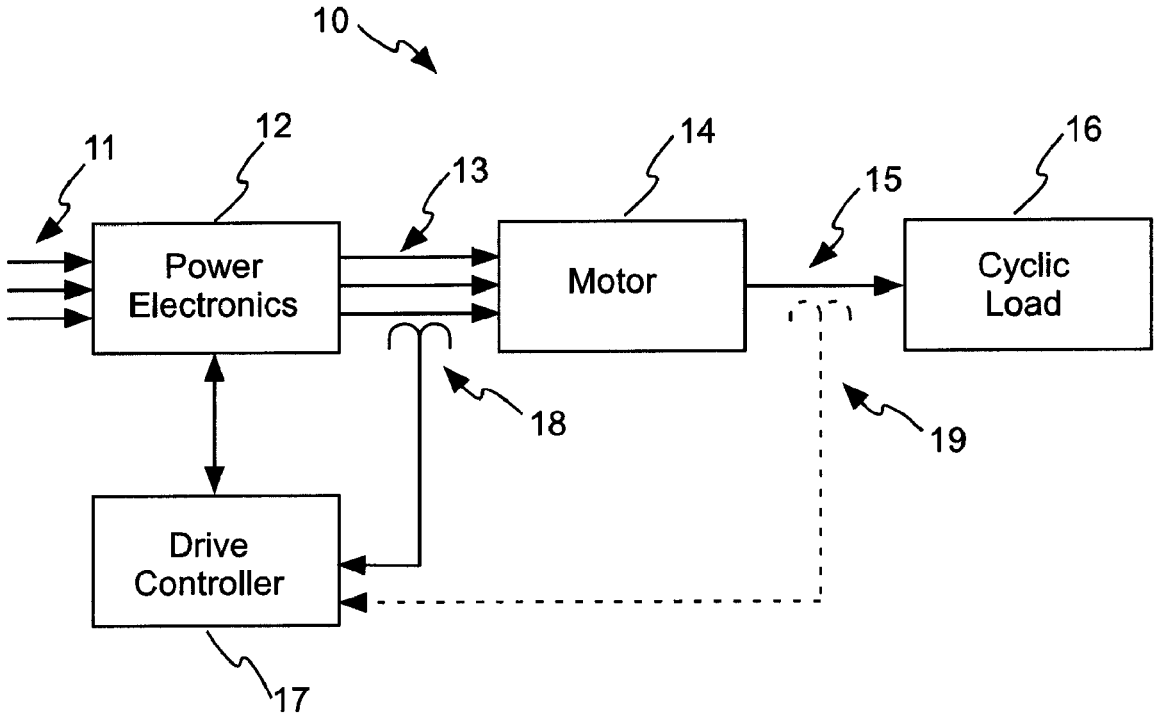
FIG. 1 is a block diagram of an environment in which the invention may be implemented.

Turning to the drawings, wherein like reference numerals refer to like elements, a typical environment shall be described prior to describing the details of the invention. FIG. 1 illustrates an example of a suitable environment 10 in which the invention may be implemented. Input power 11, which is typically three phase ac power, is provided to power electronics 12 which, in turn, provides three phase ac output power 13 to motor 14. Alternatively, dc power may be provided to the motor 14. Power electronics 12 is controlled by drive controller 17 to vary the output power 13 provided to the motor 14. Motor 14 provides mechanical output power 15 to a load 16 that is cyclic in nature. The drive controller 17 may be integral with the power electronics 12 and/or the motor 14. One or more sensors 18 provide feedback of the current and/or voltage of the output power 13 to controller 17. The sensors 18 may be external sensors or internal to the power electronics 12. Additional sensors 19 may be used to monitor the mechanical operation of the motor output 15 or the cyclic load 16. The load 16 has a rotational mass that results in a cyclic torque load such as that shown in FIG. 7.

Figure 2:
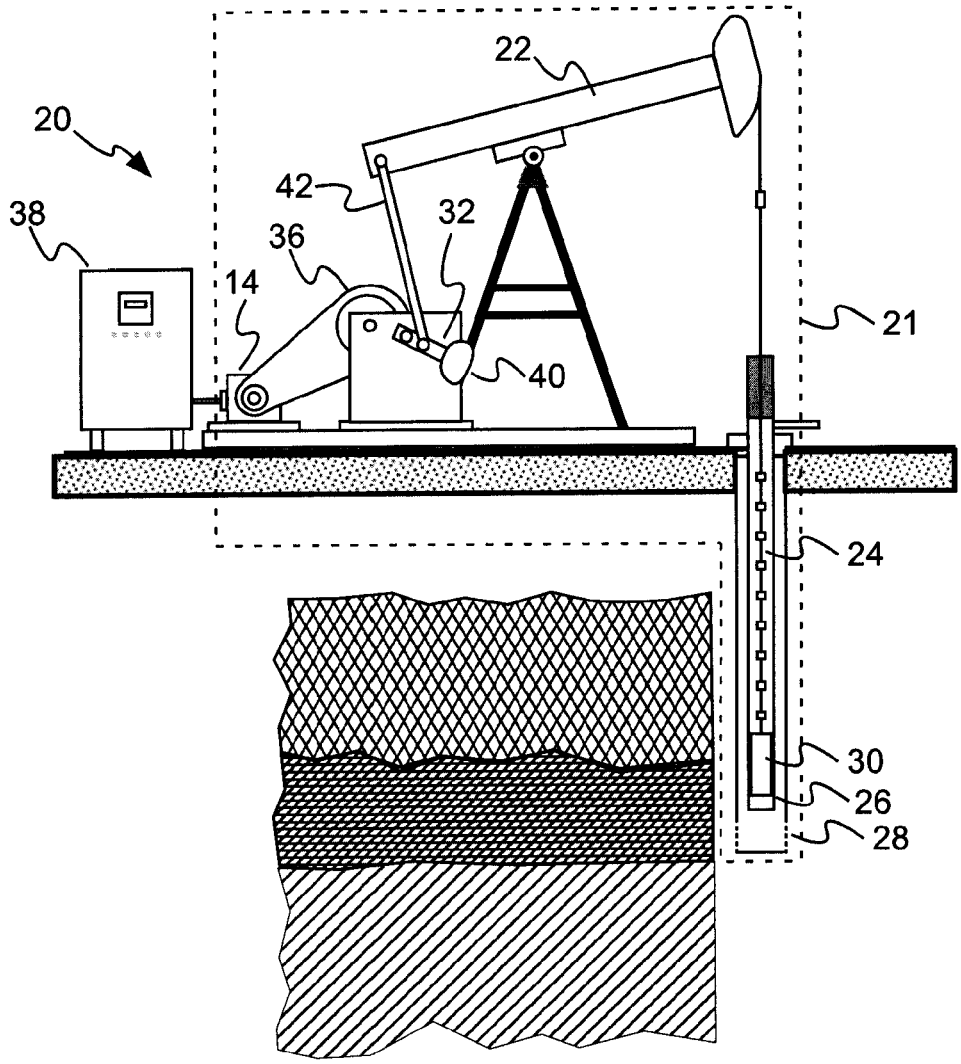
FIG. 2 is a simplified representation of a rod pump system including a control system in which the flat power control in accordance with the present invention may be implemented.

One such system that experiences a cyclic torque load is a rod pump system. Turning now to FIG. 2, a rod pump system 20 that includes a conventional beam pump system 21 and a pump controller 38 is shown. The beam pump system 21 has a walking beam 22 that reciprocates a rod string 24. The rod string 24 is suspended from the beam 22 for actuating a downhole pump 26 that is disposed at the bottom of a well 28. The downhole pump 26 is a reciprocating type pump having a plunger 30 attached to the end of the rod string 24. The system and methods provided by the invention are applicable to any system that uses an electric motor to reciprocate a rod string, including those that drive the rod through belt or chain drives. For example, a belt driven pumping unit includes a belt that is coupled to a rod string for reciprocating the rod string vertically within a well as the belt is driven by a motor.

The walking beam 22, in turn, is actuated by a pitman arm 42 which is reciprocated by a crank arm 32 driven by an electric motor 14 that is coupled to the crank arm 32 through a gear reduction mechanism, such as gearbox 36 and is controlled by pump controller 38. The typical motor 14 can be a three-phase AC induction motor operable at 460 VAC and developing 10-125 horsepower, depending upon the capacity and depth of the pump. Other types of motors such as synchronous motors can be used to drive the pumping unit. The gearbox 36 converts motor torque to a low speed but high torque output for driving the crank arm 32. The crank arm 32 is provided with a counterweight 40 that serves to balance the rod string 24 suspended from the beam 22 as is known in the art. Counterbalance can also be provided by other means such as an air cylinder or beam mounted counterweights. Belted pumping units may use a counterweight that runs in the opposite direction of the rod stroke or an air cylinder for counterbalance.

Figure 3:
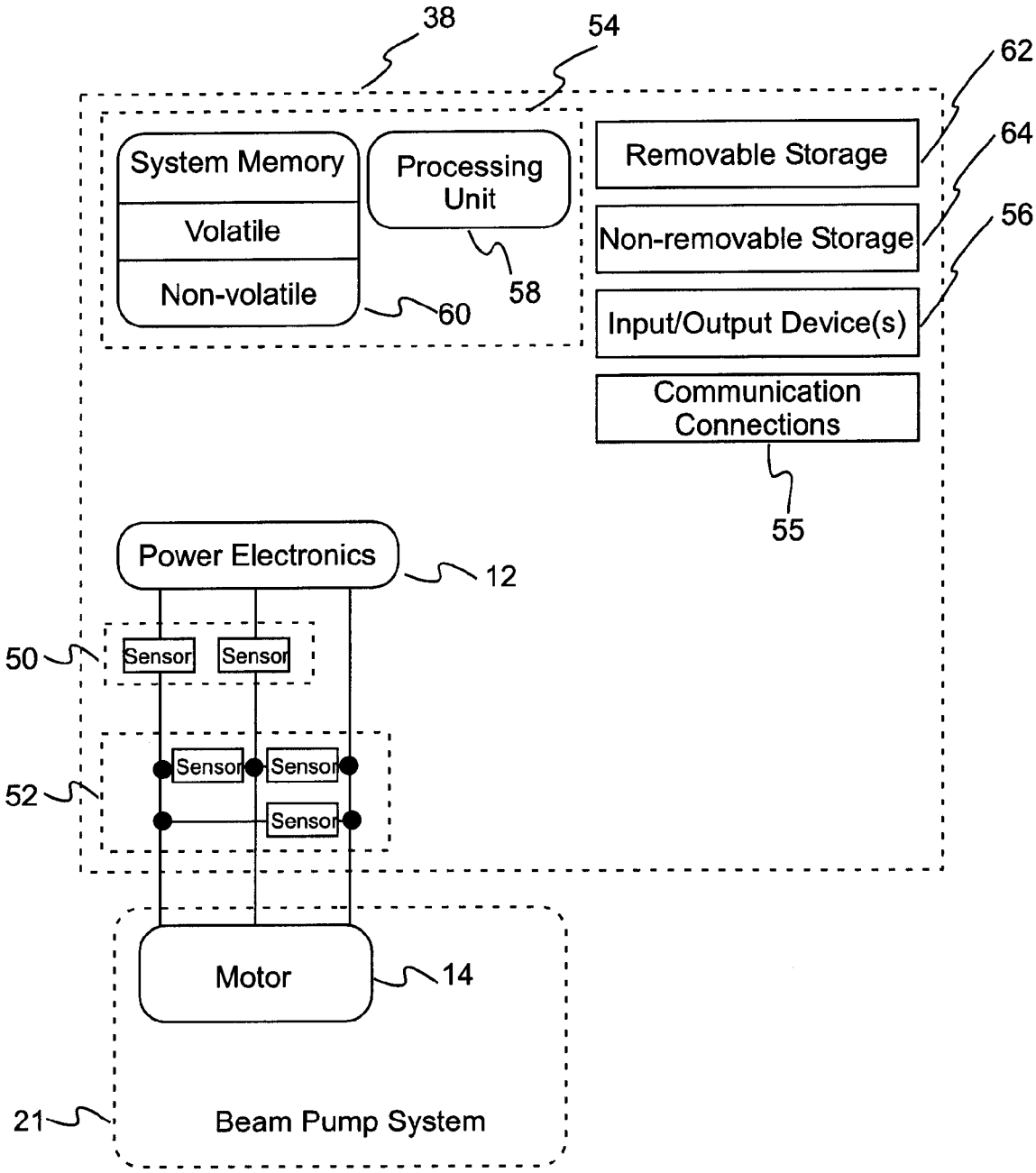
FIG. 3 is a block diagram of the control system of FIG. 2.

Turning now to FIG. 3, a simplified representation of the pump controller 38 including the power control in accordance with the present invention is shown. The pump controller 38 determines parameters relating to operation of the beam pump system 21 from motor data without the need for external instrumentation and uses these parameters to manage the power demand such that power demand variation is attenuated or eliminated using instantaneous data. In one embodiment, instantaneous motor currents and voltages are monitored and adjusted to achieve zero variation of the power through continuous manipulation of the motor torque as a function of feedback velocity of the motor 14 using the rotational inertia of the beam pump system 21. This embodiment shall be referred to as flat power control in the description that follows. In another embodiment, instantaneous motor currents and voltages are monitored and adjusted to achieve reduced power variation through continuous manipulation of the motor velocity as a function of feedback torque of the motor 14 using the rotational inertia of the beam pump system 21. This embodiment shall be referred to as peak reduction power control in the description that follows.

The pump controller 38 includes transducers, such as current and voltage sensors, to sense dynamic variables associated with motor torque and velocity. As shown in FIG. 3, current sensors 50 are coupled to a sufficient number of the motor leads for the type of motor used. The current sensors 50 provide voltages proportional to the instantaneous stator currents in the motor 14. Voltage sensors 52 are connected across to a sufficient number of the motor windings for the type of motor used and provide voltages proportional to the instantaneous voltages across the motor windings. The current and voltage signals produced by sensors 50 and 52 are supplied to a processor 54 through suitable input/output devices 56. In its most basic configuration, the processor 54 typically includes a processing unit 58 and memory 60. Depending on the exact configuration and type of computing device, memory 60 may be volatile (such as RAM), non-volatile (such as ROM, flash memory, etc.) or some combination of the two. Pump controller 38 may also have storage devices (removable storage 62 and/or non-removable storage 64) which store programs and data files used in calculating operating parameters and producing control signals for controlling the power input of the rod pump system 20. Additionally, pump controller 38 may have communication connections 55 for interfacing the pump controller with central control systems, reporting data to a remote operator, triggering alarm signals or the like.

Figure 7:
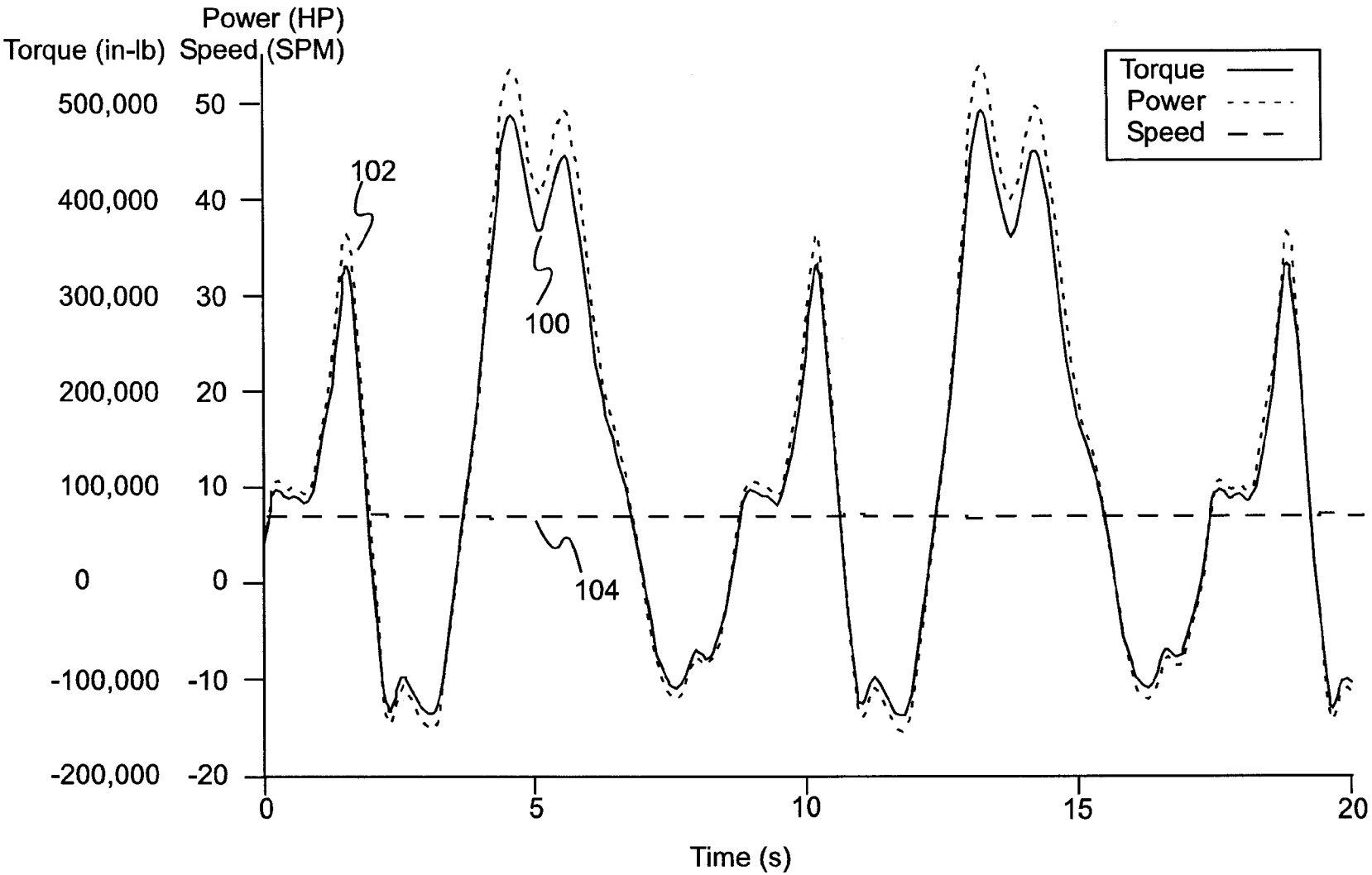
FIG. 7 is graph illustrating crank torque, motor power draw and speed for the control system of FIG. 4 with the flat power control disabled.

Motor currents and voltages are sensed to determine the instantaneous torque and velocity provided by the motor 14. As the rod string 24 that drives the downhole pump 26 is raised and lowered during each cycle, the motor 14 is cyclically loaded as shown in FIG. 7. Turning briefly to FIG. 7, crank torque 100, motor power 102 (and thus input power demand) and pump speed 104 are shown. It can be seen that the power demand is both cyclic and, for a portion of the machine cycle, regenerative. Flat power control or peak reduction power control is used when zero or reduced power demand variation is either required or desired, as in generator powered applications. The cyclic loading of the rod pump applications are particularly demanding on generators, typically causing generator over-speeding and/or stalling as the load changes, consequently requiring over-sizing of the generator to meet the application. The flat power control or peak reduction power control prevents the generator from over-speeding or stalling, thereby reducing the overall size requirement for the generator as well as extending the life of the generator.

Figure 4:
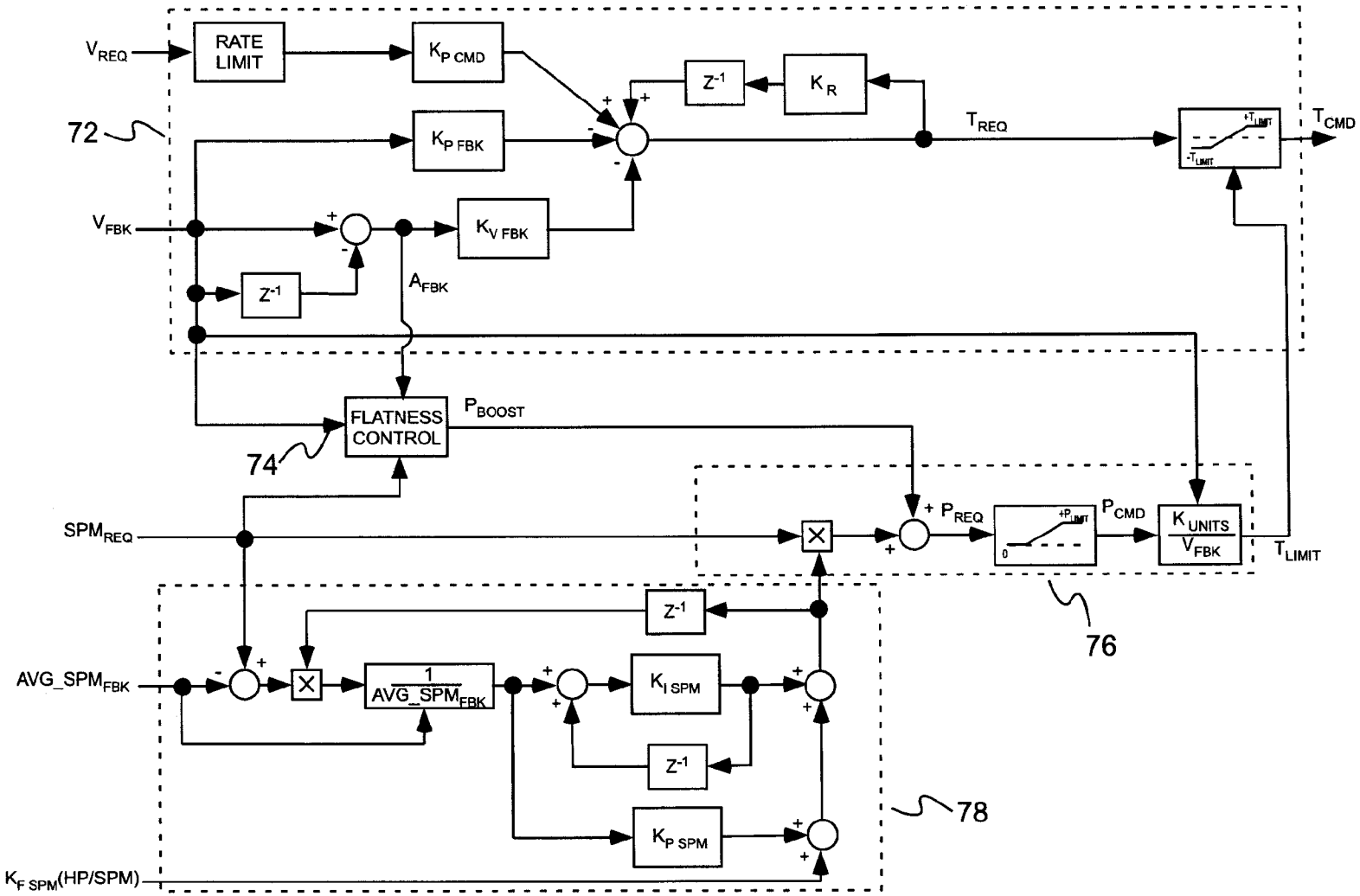
FIG. 4 is a block diagram of an implementation of the flat power control interfacing with a normal velocity control operation of the control system of FIG. 3 in accordance with the teachings of the present invention.

Turning now to FIG. 4, a block diagram of a flat power control 70 of the controller 38 is shown for achieving a flat power draw. The flat power control 70 may be described in the general context of computer-executable instructions, such as program modules, executed by one or more devices. Generally, program modules include routines, programs, objects, components, data structures, etc. that perform particular tasks or implement particular abstract data types. Typically the functionality of the program modules may be combined or distributed as desired in various embodiments.

In one embodiment, the pump controller 38 accomplishes a flat power draw through continuous manipulation of the motor torque as a function of feedback velocity using the rotational mass of the beam pumping system 21 to store and retrieve the necessary energy to achieve the flat power draw. In FIG. 4, a velocity control section 72 is used to provide over speed protection for the system. $V_{REQ}$ is a velocity request that is set to a value equal to the safe maximum speed of the motor and mechanical system in order to cause the torque request output $T_{REQ}$ to exceed the torque limit $T_{LIMIT}$. $V_{FBK}$ is the instantaneous feedback velocity, $SPM_{REQ}$ is the requested speed in strokes per minute, and $AVG_SPM_{FBK}$ is average feedback speed in strokes per minute. If $V_{FBK}$ exceeds $V_{REQ}$, the torque request $T_{REQ}$ will reduce to a level less than the torque limit $T_{LIMIT}$ and the flat power control will transition to speed control to protect the motor and the rest of the mechanical system.

If traditional speed control operation is desired, $V_{REQ}$ is set to a desired value, passed through a rate limiter to prevent the effects of large step commands and scaled by a proportional gain $K_{P\ CMD}$. The instantaneous feedback velocity $V_{FBK}$ is input to a PI (proportional integral) stage with an integral gain $K_{P\ FBK}$ and a proportional gain $K_{V\ FBK}$. The output of the PI stage is subtracted from the rate limited and scaled velocity command, and the resulting signal is input to an integrator with gain KR. The output of the integrator is input to a torque limiter, which has a limit $T_{LIMIT}$ set to a value designed to protect the motor and the mechanical system such that $T_{REQ}$ is normally not greater than $T_{LIMIT}$. The resulting signal is $T_{CMD}$, the torque command to the motor drive.

If flat power operation is desired, $V_{REQ}$ is set to a value that causes output $T_{REQ}$ of the velocity control section 72 to saturate at a value greater than or equal to the torque limit. During this mode of operation, power is regulated by the flat power control section 76, which multiplies the average speed request $SPM_{REQ}$ by an automatically adjustable scaling factor. The resulting value is added to a $P_{BOOST}$ value that is generated in the flatness control block 74, thereby generating the power request, $P_{REQ}$. The scaling factor is initially the operator set value of $K_{F\ SPM}$ (HP/SPM). At a given point during each stroke of the pump, the scaling factor adjustment algorithm 78 subtracts the value of $AVG_SPM_{FBK}$ from $SPM_{REQ}$ to generate a cycle speed error for the pump, which is then scaled and input to a PI controller with gains of $K_{I\ SPM}$ and $K_{P\ SPM}$. The output of this PI controller is added as an offset to the original $K_{F\ SPM}$ value. In steady state operation, the foregoing will force the cycle speed error to zero. $P_{REQ}$ is then limited in both magnitude and rate of change to values that are acceptable to the components of the overall system, resulting in the value $P_{CMD}$. The $P_{CMD}$ value is then divided by the instantaneous feedback speed $V_{FBK}$ and scaled by a factor $K_{UNITS}$ to a percentage of the motor drive maximum rating. The resulting signal, $T_{LIMIT}$, is the instantaneous torque command corresponding to the power request, which becomes the torque limit. Since the velocity control section 72 is saturated, $T_{LIMIT}$ becomes the torque command $T_{CMD}$.

Figure 5:
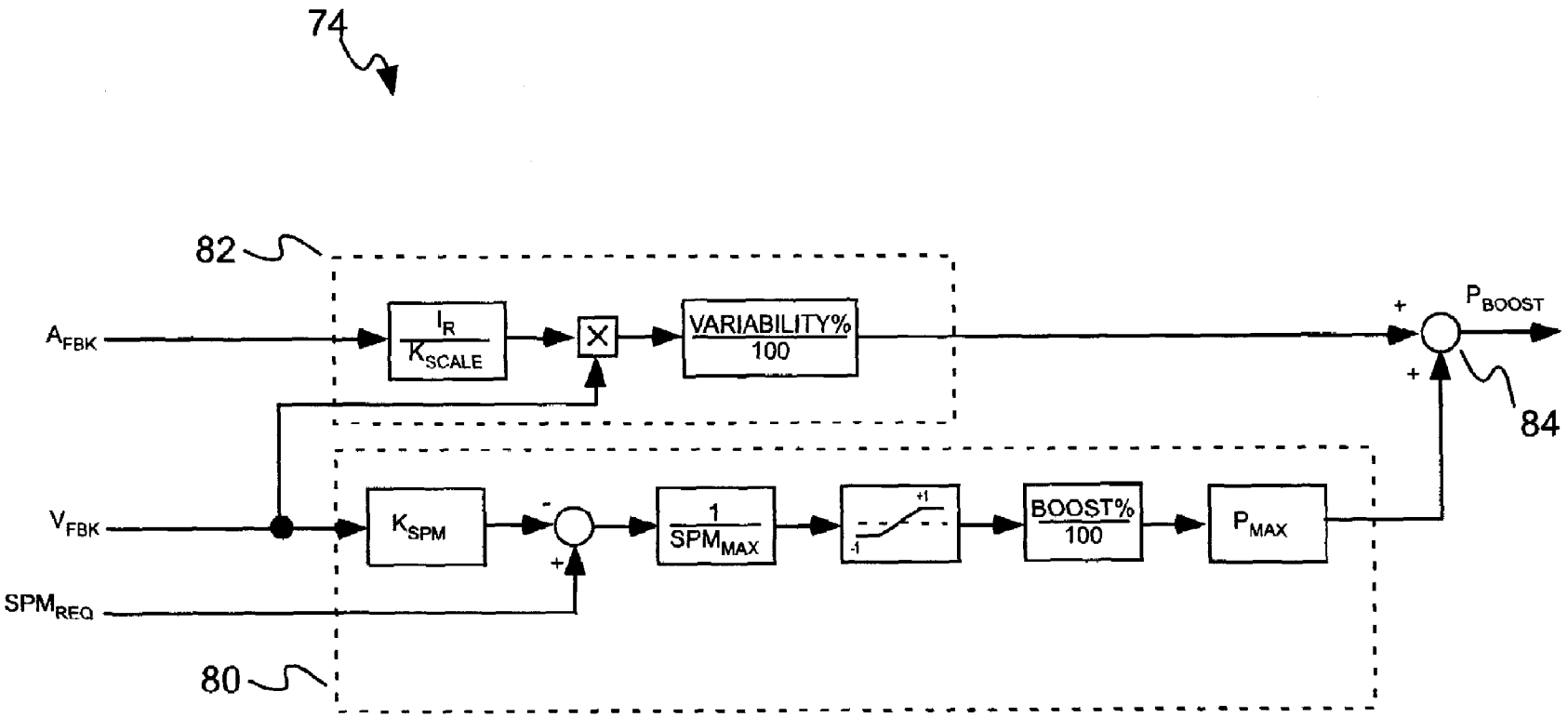
FIG. 5 is a block diagram of the flatness control block which is part of the flat power control implementation of FIG. 4.

Turning now to FIG. 5, a block diagram of the flatness control 74 of FIG. 4 is shown. This control provides the ability to further control the instantaneous speed of the beam pump system 21 than the flat power control of section 76. The flatness control 74 reduces velocity fluctuation and increases peak power variation. The flatness control 74 has an acceleration compensation loop 82 and a velocity error section 80 which are summed at summing point 84 to produce a signal, $P_{BOOST}$, which provides controlled variability to the power control of FIG. 4.

The acceleration compensation 82 works by multiplying the acceleration of the rotary inertia, $A_{FBK}$, by the rotary inertia, $I_R$, then dividing by $K_{SCALE}$ to convert to the correct units of torque. The resulting torque is multiplied by the velocity $V_{FBK}$ to determine the amount of power being transferred into or out of the rotating inertia. This power level is multiplied by a user supplied value VARIABILITY % to limit the amount of power that will be compensated. A value of zero disables this section.

The velocity error section 80 works by scaling the velocity $V_{FBK}$ by scaling factor $K_{SPM}$ to determine the instantaneous cycle speed for the machine and subtracting the instantaneous cycle speed of the machine from the desired speed $SPM_{REQ}$ to determine an instantaneous cycle speed error. The instantaneous cycle speed error is divided by a value $SPM_{MAX}$ (maximum speed) to determine what portion of maximum speed is attributed to the instantaneous cycle speed error. This result is limited to an absolute value, and then multiplied by a user supplied value, BOOST %, to limit the amount of power that will be compensated. In one embodiment, the absolute value limit is set to one. The output of the BOOST % block is then multiplied by the value of $P_{MAX}$ to generate the output of the velocity error section 80. A BOOST % value of zero disables this section.

Figure 6:
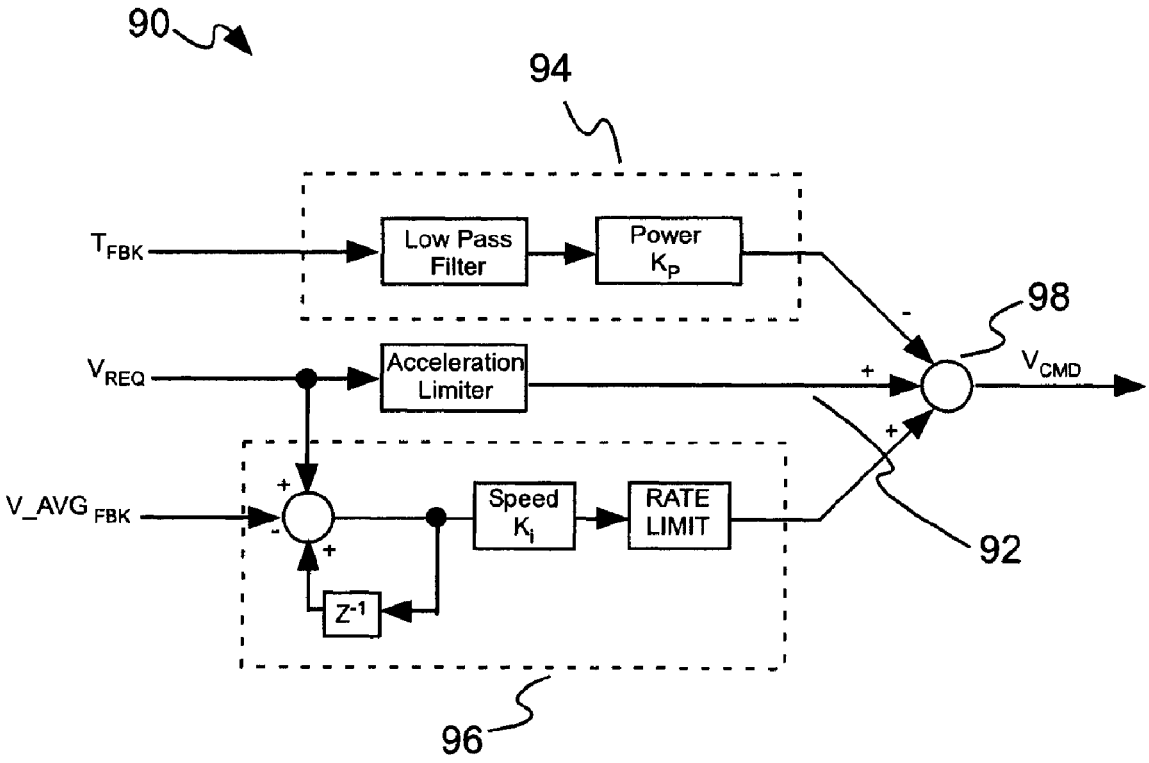
FIG. 6 is a block diagram of a peak reduction power control implementation interfacing with a normal velocity control operation of the control system of FIG. 3 in accordance with the teachings of the present invention.

Turning now to FIG. 6, a block diagram of a peak reduction power control 90 of the controller 38 is shown. This control provides further control of the instantaneous speed of the beam pump system 21 in comparison to the flat power control. However, while the peak reduction power control 90 reduces the peak power levels, it results in greater variation in power levels than the flat power control. Peak reduction power control is accomplished in one embodiment through the summing of three control paths. These control paths are the velocity request path 92, the torque compensation path 94 and the speed error path 96, which are summed at the summing point 98.

The velocity request path 92 provides the basic velocity command for the motor. The velocity request, $V_{REQ}$, is input to an acceleration limiter that helps prevent sudden changes in power caused by changing velocity requests and the result is added to the summing point 98. The torque compensation path 94 is a proportional controller that uses the torque provided by the motor $T_{FBK}$ to limit the peak power. $T_{FBK}$ is filtered through a low pass filter and then multiplied by a proportional gain, Power $K_P$. The result is subtracted from the outputs of the velocity request path 92 and speed error path 96 at summing point 98.

The speed error path 96 subtracts the average speed of the motor ($V_AVG_{FBK}$) from the requested speed for the motor ($V_{REQ}$) to generate an error term. This error term is integrated and multiplied by the integral gain Speed $K_I$. The result is limited in its rate of change by a rate limiter before being summed at the summing point 98. In steady state operation, the speed error path 96 will cause the average velocity error to be at or near zero.

Figure 8:
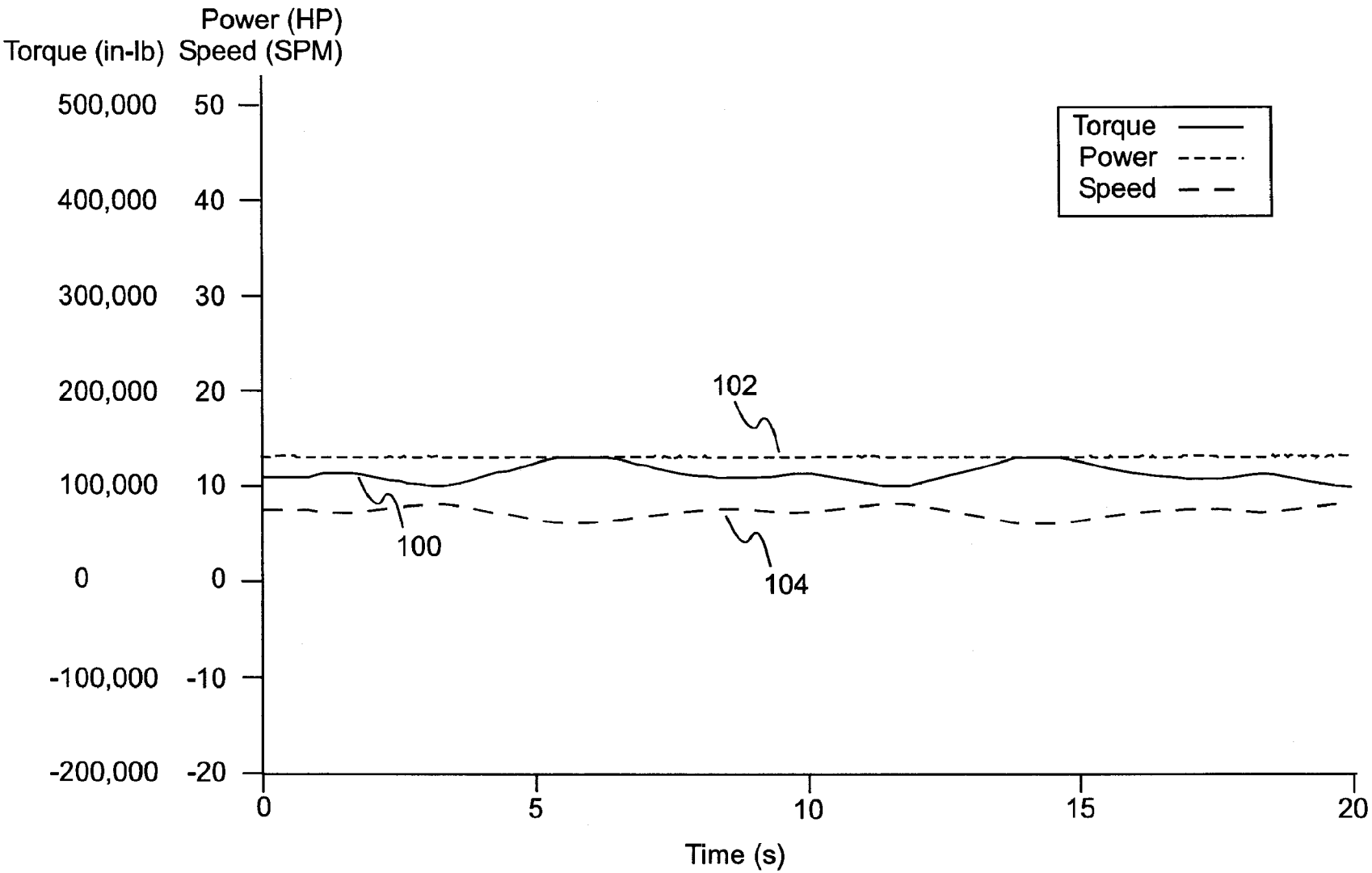
FIG. 8 is graph illustrating crank torque, motor power draw and speed for the control system of FIG. 4 with the flat power control enabled.
Figure 9:
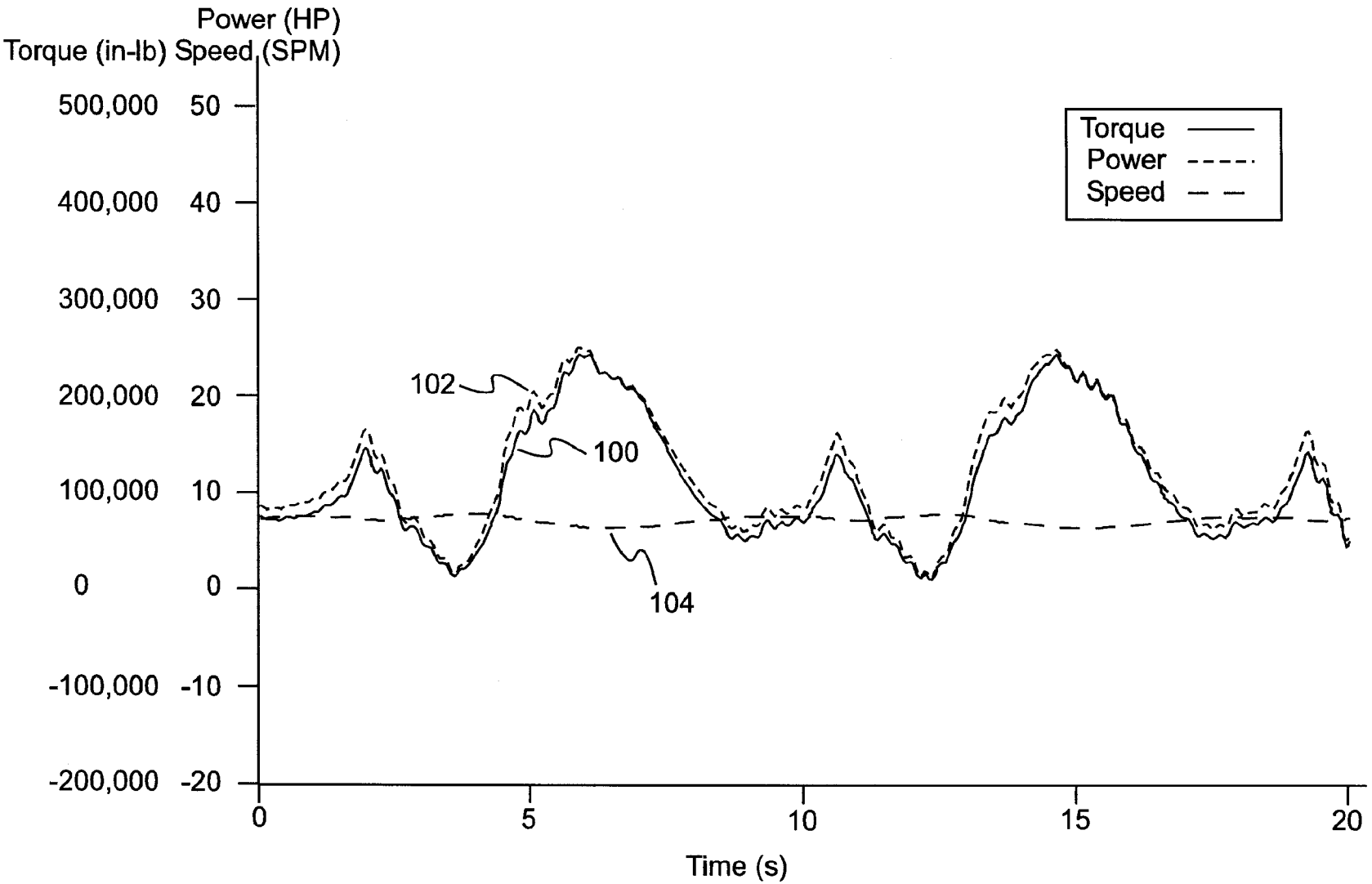
FIG. 9 is graph illustrating crank torque, motor power draw and speed for the peak reduction power control system of FIG. 6.

Turning now to FIGS. 7 through 9, crank torque 100, motor power 102 (and thus input power demand) and pump speed 104 show the results of mathematical modeling of normal operation (FIG. 7), of the flat power control 70 (FIG. 8), and of the peak reduction power control 90 (FIG. 9) at the same average speed. It can clearly be seen that with the flat power control 70, the motor power 102 is constant, resulting in the power draw variation being essentially eliminated while the pump speed 104 has some variation. The variation in pump speed is due to the rotational mass of the pump storing and delivering energy in order to "flatten" the power drawn by the motor 14. It can also be seen that, with the use of the peak reduction power control 90 instead of the flat power control 70, the motor power 102 (and therefore input power) has peaks approximately half those of normal operation and that any power regeneration has been eliminated while allowing for less variation of the motor speed than the flat power control 70.

From the foregoing, it can be seen that a method and system to attenuate or eliminate power demand variation using instantaneous data has been described. The power control does not require any prior knowledge (i.e., historical data) of the power control system. This eliminates the need to complete one or more cycles of the machine being controlled to collect data for use in the control and allows the reduction or elimination of power variation from the moment a machine is started. The control prevents the machine and the generator, if there is one, from overspeeding or stalling, thereby reducing the overall size requirements for the machine components and generator as well as extending the life of the machine components and generator.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "signal" is to be construed to include both digital and analog representations of data. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for reducing the power demand variations of a motor for driving a mechanical system having a cyclic load and a rotating inertia, the method comprising the steps of:

determining a signal representing a velocity output of the motor;

generating a torque limit signal by multiplying a signal representing a desired power level of the mechanical system by a torque scaling factor divided by the signal representing the velocity output of the motor; and causing the motor to operate at the torque represented by the torque limit signal.

2. The method of claim 1 wherein an electrical generator that is independent from a utility electric grid is the source of electrical power for the motor.

3. The method of claim 2 wherein the mechanical system is a rod pump system.

4. The method of claim 1 wherein the mechanical system is a rod pump system.

5. The method of claim 1 wherein the signal representing the desired power level is generated by multiplying a signal representing a desired cycle speed of the mechanical system by a power scaling factor.

6. The method of claim 5 wherein an electrical generator that is independent from a utility electric grid is the source of electrical power for the motor.

7. The method of claim 6 wherein the mechanical system is a rod pump system.

8. The method of claim 5 wherein the mechanical system is a rod pump system.

9. The method of claim 5 wherein the power scaling factor is generated by the step comprising using a cycle speed error signal to adjust the power scaling factor.

10. The method of claim 9 wherein the cycle speed error signal is generated by the steps comprising:

generating a signal representing the actual cycle speed of the mechanical system; and using the signal representing the actual cycle speed of the mechanical system and the signal representing the desired cycle speed of the mechanical system to determine a cycle speed error signal.

11. The method of claim 9 wherein an electrical generator that is independent from a utility electric grid is the source of electrical power for the motor.

12. The method of claim 11 wherein the mechanical system is a rod pump system.

13. The method of claim 9 wherein the mechanical system is a rod pump system.

14. A method for reducing the power demand variations of a motor for driving a mechanical system having a cyclic load and a rotating inertia, the method comprising the steps of:

determining a first velocity command offset signal based upon a torque output of the motor;

determining a second velocity command offset signal based upon an average velocity error of the motor;

generating a combined velocity command signal comprising a combination of the first velocity command offset signal, the second velocity command offset signal and a set velocity command signal; and causing the motor to operate at the velocity represented by the combined velocity command signal.

15. The method of claim 14 wherein an electrical generator that is independent from a utility electric grid is the source of electrical power for the system.

16. The method of claim 14 wherein the mechanical system is a rod pump system.

17. The method of claim 15 wherein the mechanical system is a rod pump system.

18. A control system for reducing the power demand variations of a motor for driving a mechanical system, said mechanical system having a cyclic load and a rotating inertia, the control system comprising:

means for generating a torque limit signal by multiplying a signal representing a desired power level of the system by a torque scaling factor divided by a signal representing the velocity output of the motor; and means for causing the motor to operate at the torque represented by the torque limit signal.

19. The control system of claim 18 further comprising an electrical generator that is independent from a utility electric grid as the source of electrical power for the motor.

20. The control system of claim 19 wherein the mechanical system is a rod pump system.

21. The control system of claim 18 wherein the mechanical system is a rod pump system.

22. The control system of claim 19 further comprising means for generating the signal representing the desired power level.

23. The control system of claim 22 wherein the means for generating the signal representing the desired power level includes means for multiplying a signal representing a desired cycle speed of the mechanical system by a power scaling factor.

24. The control system of claim 22, further comprising an electrical generator that is independent from a utility electric grid as the source of electrical power for the motor.

25. The control system of claim 24 wherein the mechanical system is a rod pump system.

26. The control system of claim 22 wherein the mechanical system is a rod pump system.

27. The control system of claim 22 further comprising:

means for generating a cycle speed error signal; and means using the cycle speed error signal to adjust the power scaling factor.

28. The control system of claim 27 further comprising an electrical generator that is independent from a utility electric grid as the source of electrical power for the motor.

29. The control system of claim 28 wherein the mechanical system is a rod pump system.

30. The control system of claim 27, wherein the mechanical system is a rod pump system.

31. A control system for reducing the power demand variations of a motor for driving a mechanical system, said mechanical system having a cyclic load and a rotating inertia, the control system comprising:

means for generating a first velocity command offset signal based upon a torque output of the motor;

means for generating a second velocity command offset signal based upon an average velocity error of the motor;

means for generating a combined velocity command signal comprising a combination of the first velocity command offset signal, the second velocity command offset signal and a set velocity command signal; and means for causing the motor to operate at the velocity represented by the combined velocity command signal.

32. The control system of claim 31 further comprising an electrical generator that is independent from a utility electric grid as the source of electrical power for the system.

33. The control system of claim 32 wherein the mechanical system is a rod pump system.

34. The control system of claim 31 wherein the mechanical system is a rod pump system.

* * * * *